US006282889B1

(12) United States Patent
Kakuyama et al.

(10) Patent No.: US 6,282,889 B1
(45) Date of Patent: Sep. 4, 2001

(54) AIR/FUEL RATION CONTROL SYSTEM OF INTERNAL COMBUSTION ENGINE

(75) Inventors: Masatomo Kakuyama, Yokohama; Akira Tayama, Kanagawa; Hirofumi Tsuchida, Kanagawa; Osamu Matsuno, Kanagawa, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/516,498

(22) Filed: Mar. 1, 2000

(30) Foreign Application Priority Data

Mar. 3, 1999 (JP) ..... 11-055693
Feb. 22, 2000 (JP) ..... 12-044723

(51) Int. Cl.[7] ..... F01N 3/00
(52) U.S. Cl. ..... 60/285; 60/277; 60/274
(58) Field of Search ..... 60/277, 285, 274

(56) References Cited

U.S. PATENT DOCUMENTS 5,293,740 * 3/1994 Heppner et al. ..... 60/285
5,487,269 * 1/1996 Atanasyan et al. ..... 60/277
5,842,340 * 12/1998 Bush et al. ..... 60/285
5,848,528 * 12/1998 Liu ..... 60/285
5,901,552 * 5/1999 Schnaibel et al. ..... 60/276
6,116,021 * 9/2000 Schumacher et al. ..... 60/285

FOREIGN PATENT DOCUMENTS 6-249028 9/1994 (JP) .
9-310635 12/1997 (JP) .

* cited by examiner

*Primary Examiner*—Thomas Denion
*Assistant Examiner*—Diem Tran
(74) *Attorney, Agent, or Firm*—Foley & Lardner

(57) ABSTRACT

In an automotive vehicle with at least one catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, an air/fuel ratio control system controls an air/fuel mixture ratio of the engine at as close to stoichiometric as possible, an air/fuel ratio control system calculates a quantity of oxygen stored in the catalyst on the basis of a deviation of the air/fuel ratio detected by the air/fuel ratio sensor from a stoichiometric air/fuel ratio to produce informational data indicative of a calculated value of the quantity of oxygen stored. The control system controls the air/fuel mixture ratio of the engine so that the calculated value of the quantity of oxygen stored is adjusted to a desired value. The control system has a limiter capable of preventing the calculated value of the quantity of oxygen stored from exceeding a specified level.

4 Claims, 5 Drawing Sheets

AIR/FUEL RATION CONTROL SYSTEM OF INTERNAL COMBUSTION ENGINE

BACKGROUND OF THE INVENTION

1. Field of the Invention

The present invention relates to the improvements of an air/fuel ratio control system of an internal combustion engine with an emission control system having at least a catalyst, and specifically to an air/fuel ratio control system capable of controlling an air/fuel mixture ratio so that the quantity of oxygen stored in the catalyst is adjusted toward a desired quantity.

2. Description of the Prior Art

In recent years, an automotive vehicle often uses a three-way catalyst to reduce oxides of nitrogen (BOX), unburned hydrocarbons (HCl), and carbon monoxide (CO). On automotive vehicles employing a three-way catalytic converter (a three-way catalyst) in the exhaust passage, in order to detect an air/fuel mixture ratio (often abbreviated to "A/F ratio"), an A/F ratio sensor, such as an $O_2$ sensor, is usually provided in the exhaust passage upstream of the three-way catalyst. As is generally known, the purpose of the A/F sensor such as oxygen sensor is to monitor the percentage of oxygen contained within the exhaust gases at all times when the engine is running, so that the EMU can maintain the A/F ratio at as close to stoichiometric as possible. A voltage signal from the A/F ratio sensor varies depending on the air/fuel mixture ratio. In automotive vehicles with both a three-way catalyst and an A/F ratio sensor located upstream of the three-way catalyst, an electronic engine control unit (ECU) or an electronic engine control module (ECM) generally utilizes the deviation of an A/F ratio sensed by the A/F ratio sensor from a stoichiometric air/fuel ratio to arithmetically calculate or estimate the quantity of oxygen stored in the three-way catalyst. The ECU controls the A/F ratio such that the estimate (the calculated value) of the quantity of air (oxygen) stored in the catalyst is adjusted to a desired value (for example, one-half of a limit value of the quantity of oxygen stored in the three-way catalyst). When the A/F ratio is lean (excess air), air (oxygen) is adsorbed or trapped by the three-way catalyst and stored in the catalyst. Conversely, when the A/F ratio is rich (too much fuel), air (oxygen) is desorbed or released from the three-way catalyst. Generally, an oxygen desorption speed at which oxygen is desorbed from the three-way catalyst is lower than an oxygen adsorption speed at which oxygen is adsorbed by the three-way catalyst. For the reasons discussed above, the ECU increasingly compensates for the quantity of oxygen stored in the three-way catalyst, which quantity will be hereinafter referred to as an "oxygen storage quantity", by increasing an increment for a calculated value (or an estimate) of oxygen storage quantity, when the sensed A/F ratio is lean (excess air). To the contrary, when the sensed A/F ratio is rich (too much fuel), the ECU decreasingly compensates for the oxygen storage quantity, by decreasing a decrement for the calculated value (or the estimate) of oxygen storage quantity. Such A/F ratio control systems have been disclosed in Japanese Patent Provisional Publication Nos. 9-310635 and 6-249028.

SUMMARY OF THE INVENTION

In an automotive vehicle having an A/F ratio control system as described previously, if the actual air/fuel ratio becomes ultra lean, for example during deceleration fuel-cutoff operation, the actual oxygen storage quantity of the three-way catalyst will reach its limit value soon. However, the arithmetic-calculation section of the ECU continues arithmetic operation for the oxygen storage quantity based on the A/F sensor signal. In such a case, there is a possibility that the calculated value (or the estimate) of oxygen storage quantity is estimated or calculated as an excessive value greater than the limit value of oxygen storage quantity, even when the actual oxygen storage quantity of the three-way catalyst is kept at the limit value of oxygen storage quantity. As discussed above, there is a problem of a remarkable difference between the calculated value of oxygen storage quantity produced by the ECU and the actual oxygen storage quantity, when the A/F ratio is reduced to below an excessively lean A/F ratio less than a predetermined threshold, such as during deceleration fuel-cutoff operation. Assuming that the engine/vehicle operating condition is recovered from the previously-noted deceleration fuel-cutoff operating mode to a normal operating mode, there is a possibility of a malfunction in the A/F ratio control system owing to such an undesirably excessive rise in the calculated value of oxygen storage quantity. Also, the excessive rise in the calculated value of oxygen storage quantity may degrade the performance of the A/F ratio control system.

Accordingly, it is an object of the invention to provide an air/fuel mixture ratio control system of an internal combustion engine which avoids the aforementioned disadvantages of the prior art.

In order to accomplish the aforementioned and other objects of the present invention, an air/fuel ratio control system of an internal combustion engine comprises a catalyst located in an exhaust passage, for adsorbing oxygen contained within exhaust gases entering the catalyst, an air/fuel ratio sensor located in the exhaust passage upstream of the catalyst for detecting an air/fuel ratio based on a percentage of oxygen contained within the exhaust gases flowing through the exhaust passage and entering the catalyst, and a control unit configured to be electronically connected to the air/fuel ratio sensor for controlling an air/fuel mixture ratio at as close to stoichiometric as possible, the control unit comprising an arithmetic-calculation section which calculates a quantity of oxygen stored in the catalyst on the basis of a deviation of the air/fuel ratio detected by the air/fuel ratio sensor from a stoichiometric air/fuel ratio to produce informational data indicative of a calculated value of the quantity of oxygen stored, a control section which controls the air/fuel mixture ratio so that the calculated value of the quantity of oxygen stored is adjusted to a desired value, and a limiter which prevents the calculated value of the quantity of oxygen stored from exceeding a specified level.

According to another aspect of the invention, an air/fuel ratio control system of an internal combustion engine comprises a catalyst located in an exhaust passage, for adsorbing oxygen contained within exhaust gases entering the catalyst, an air/fuel ratio sensor located in the exhaust passage upstream of the catalyst for detecting an air/fuel ratio based on a percentage of oxygen contained within the exhaust gases flowing through the exhaust passage and entering the catalyst, and a control unit configured to be electronically connected to the air/fuel ratio sensor for controlling an air/fuel mixture ratio at as close to stoichiometric as possible, the control unit comprising an arithmetic-calculation section which calculates a quantity of oxygen stored in the catalyst on the basis of a deviation of the air/fuel ratio detected by the air/fuel ratio sensor from a stoichiometric air/fuel ratio to produce informational data indicative of a calculated value of the quantity of oxygen stored, a control section which controls an air/fuel mixture ratio so that the calculated value of the quantity of oxygen stored is adjusted to a desired value, and a limiter which prevents the calculated value of the quantity of oxygen stored from exceeding a predetermined limit value of the quantity of oxygen stored in the catalyst, the limiter comprising a determination section which determines whether the engine operates at a fuel cutoff operating mode, and an update section which, when the calculated value of the quantity of oxygen stored is above the predetermined limit value during the fuel cutoff operating mode, terminates arithmetic-operation for the quantity of oxygen stored, executed by the arithmetic-calculation section, and updates the calculated value by the predetermined limit value.

According to another aspect of the invention, an air/fuel ratio control system of an internal combustion engine comprises a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, a downstream air/fuel ratio sensor located in the exhaust passage downstream of the catalyst for detecting an air/fuel ratio based on a percentage of oxygen contained within the exhaust gases flowing through the exhaust passage and leaving the catalyst, and a control unit configured to be electronically connected to the upstream and downstream air/fuel ratio sensors, for controlling an air/fuel mixture ratio at as close to stoichiometric as possible, the control unit comprising an arithmetic-calculation section which calculates a quantity of oxygen stored in the catalyst on the basis of a deviation of the air/fuel ratio detected by the upstream air/fuel ratio sensor from a stoichiometric air/fuel ratio, to produce informational data indicative of a calculated value of the quantity of oxygen stored, a control section which controls an air/fuel mixture ratio so that the calculated value of the quantity of oxygen stored is adjusted to a desired value, and a limiter which prevents the calculated value of the quantity of oxygen stored from exceeding a specified level, the limiter comprising a determination section which determines whether the air/fuel ratio detected by the downstream air/fuel ratio sensor is leaner than a predetermined lean air/fuel ratio criterion. The limiter may further comprise an update section which, when the determination section determines that the air/fuel ratio detected by the downstream air/fuel ratio sensor is leaner than the predetermined lean air/fuel ratio criterion, terminates arithmetic-operation for the quantity of oxygen stored, executed by the arithmetic-calculation section, and updates the calculated value by a predetermined limit value.

According to a further aspect of the invention, an air/fuel ratio control system of an internal combustion engine comprises a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, a downstream air/fuel ratio sensor located in the exhaust passage downstream of the catalyst for detecting an air/fuel ratio based on a percentage of oxygen contained within the exhaust gases flowing through the exhaust passage and leaving the catalyst, and a control unit configured to be electronically connected to the upstream and downstream air/fuel ratio sensors for controlling an air/fuel mixture ratio at as close to stoichiometric as possible, the control unit comprising an arithmetic-calculation section which calculates a quantity of oxygen stored in the catalyst on the basis of a deviation of the air/fuel ratio detected by the upstream air/fuel ratio sensor from a stoichiometric air/fuel ratio to produce informational data indicative of a calculated value of the quantity of oxygen stored, a control section which controls an air/fuel mixture ratio so that the calculated value of the quantity of oxygen stored is adjusted to a desired value, and a limiter which prevents the calculated value of the quantity of oxygen stored from exceeding a predetermined limit value of the quantity of oxygen stored in the catalyst, the limiter comprising a determination section which determines whether the air/fuel ratio detected by the downstream air/fuel ratio sensor is a leaner air/fuel ratio than the stoichiometric air/fuel ratio, and an update section which, when the determination section determines that the air/fuel ratio detected by the downstream air/fuel ratio sensor is the leaner air/fuel ratio and the calculated value of the quantity of oxygen stored is above the predetermined limit value, terminates arithmetic-operation for the quantity of oxygen stored, executed by the arithmetic-calculation section, and updates the calculated value by the predetermined limit value.

According to another aspect of the invention, in an internal combustion engine having a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, an air/fuel ratio control system for controlling an air/fuel mixture ratio of the internal combustion engine at as close to stoichiometric as possible comprises an arithmetic-calculation means for calculating a quantity of oxygen stored in the catalyst on the basis of a deviation of the air/fuel ratio detected by the air/fuel ratio sensor from a stoichiometric air/fuel ratio to produce informational data indicative of a calculated value of the quantity of oxygen stored, a control means for controlling the air/fuel mixture ratio so that the calculated value of the quantity of oxygen stored is adjusted to a desired value, and a limiter means for preventing the calculated value of the quantity of oxygen stored from exceeding a specified level.

According to a further aspect of the invention, in an internal combustion engine having a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, an air/fuel ratio control system for controlling an air/fuel mixture ratio of the internal combustion engine at as close to stoichiometric as possible comprises an arithmetic-calculation means for calculating a quantity of oxygen stored in the catalyst on the basis of a deviation of the air/fuel ratio detected by the air/fuel ratio sensor from a stoichiometric air/fuel ratio to produce informational data indicative of a calculated value of the quantity of oxygen stored, a control means for controlling an air/fuel mixture ratio so that the calculated value of the quantity of oxygen stored is adjusted to a desired value, and a limiter means for preventing the calculated value of the quantity of oxygen stored from exceeding a predetermined limit value of the quantity of oxygen stored in the catalyst, the limiter means comprising a determination means for determining whether the engine operates at a fuel cutoff operating mode, and an update means for terminating arithmetic-operation for the quantity of oxygen stored, executed by the arithmetic-calculation means and for updating the calculated value by the predetermined limit value, when the calculated value of the quantity of oxygen stored is above the predetermined limit value during the fuel cutoff operating mode.

According to another aspect of the invention, in an internal combustion engine having a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, and a downstream air/fuel ratio sensor located in the exhaust passage downstream of the catalyst for detecting an air/fuel ratio based on a percentage of oxygen contained within the exhaust gases flowing through the exhaust passage and leaving the catalyst, an air/fuel ratio control system for controlling an air/fuel mixture ratio of the internal combustion engine at as close to stoichiometric as possible, comprises an arithmetic-calculation means for calculating a quantity of oxygen stored in the catalyst on the basis of a deviation of the air/fuel ratio detected by the upstream air/fuel ratio sensor from a stoichiometric air/fuel ratio, to produce informational data indicative of a calculated value of the quantity of oxygen stored, a control means for controlling an air/fuel mixture ratio so that the calculated value of the quantity of oxygen stored is adjusted to a desired value, and a limiter means for preventing the calculated value of the quantity of oxygen stored from exceeding a specified level, the limiter comprising a determination means for determining whether the air/fuel ratio detected by the downstream air/fuel ratio sensor is leaner than a predetermined lean air/fuel ratio criterion. The limiter means may further comprise an update means for terminating arithmetic-operation for the quantity of oxygen stored, executed by the arithmetic-calculation means and for updating the calculated value by a predetermined limit value, when the determination means determines that the air/fuel ratio detected by the downstream air/fuel ratio sensor is leaner than the predetermined lean air/fuel ratio criterion.

According to a still further aspect of the invention, in an internal combustion engine having a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, and a downstream air/fuel ratio sensor located in the exhaust passage downstream of the catalyst for detecting an air/fuel ratio based on a percentage of oxygen contained within the exhaust gases flowing through the exhaust passage and leaving the catalyst, an air/fuel ratio control system for controlling an air/fuel mixture ratio of the internal combustion engine at as close to stoichiometric as possible comprises an arithmetic-calculation means for calculating a quantity of oxygen stored in the catalyst on the basis of a deviation of the air/fuel ratio detected by the upstream air/fuel ratio sensor from a stoichiometric air/fuel ratio to produce informational data indicative of a calculated value of the quantity of oxygen stored, a control means for controlling an air/fuel mixture ratio so that the calculated value of the quantity of oxygen stored is adjusted to a desired value, and a limiter means for preventing the calculated value of the quantity of oxygen stored from exceeding a predetermined limit value of the quantity of oxygen stored in the catalyst, the limiter comprising a determination means for determining whether the air/fuel ratio detected by the downstream air/fuel ratio sensor is a leaner air/fuel ratio than the stoichiometric air/fuel ratio, and an update means for terminating arithmetic-operation for the quantity of oxygen stored, executed by the arithmetic-calculation means and for updating the calculated value by the predetermined limit value, when the determination section determines that the air/fuel ratio detected by the downstream air/fuel ratio sensor is the leaner air/fuel ratio and the calculated value of the quantity of oxygen stored is above the predetermined limit value.

According to another aspect of the invention, a method for controlling an air/fuel mixture ratio of an internal combustion engine, wherein the engine includes a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, the method comprises calculating a quantity of oxygen stored in the catalyst on the basis of a deviation of the air/fuel ratio detected by the air/fuel ratio sensor from a stoichiometric air/fuel ratio, to produce informational data indicative of a calculated value of the quantity of oxygen stored, controlling the air/fuel mixture ratio so that the calculated value of the quantity of oxygen stored is adjusted to a desired value, and preventing the calculated value of the quantity of oxygen stored from exceeding a specified level.

According to another aspect of the invention, a method for controlling an air/fuel mixture ratio of an internal combustion engine, wherein the engine includes a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, the method comprises calculating a quantity of oxygen stored in the catalyst on the basis of a deviation of the air/fuel ratio detected by the air/fuel ratio sensor from a stoichiometric air/fuel ratio, to produce informational data indicative of a calculated value of the quantity of oxygen stored, controlling an air/fuel mixture ratio so that the calculated value of the quantity of oxygen stored is adjusted to a desired value, determining whether the engine operates at a fuel cutoff operating mode, terminating arithmetic-operation for the quantity of oxygen stored and updating the calculated value by a predetermined limit value of the quantity of oxygen stored in the catalyst, when the calculated value of the quantity of oxygen stored is above the predetermined limit value during the fuel cutoff operating mode.

According to another aspect of the invention, a method for controlling an air/fuel mixture ratio of an internal combustion engine, wherein the engine includes a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, and a downstream air/fuel ratio sensor located in the exhaust passage downstream of the catalyst for detecting an air/fuel ratio based on a percentage of oxygen contained within the exhaust gases flowing through the exhaust passage and leaving the catalyst, the method comprising calculating a quantity of oxygen stored in the catalyst on the basis of a deviation of the air/fuel ratio detected by the upstream air/fuel ratio sensor from a stoichiometric air/fuel ratio, to produce informational data indicative of a calculated value of the quantity of oxygen stored, controlling an air/fuel mixture ratio so that the calculated value of the quantity of oxygen stored is adjusted to a desired value, determining whether the air/fuel ratio detected by the downstream air/fuel ratio sensor is leaner than a predetermined lean air/fuel ratio criterion, and terminating arithmetic-operation for the quantity of oxygen stored and updating the calculated value by a predetermined limit value of the quantity of oxygen stored in the catalyst, when the air/fuel ratio detected by the downstream air/fuel ratio sensor is leaner than the predetermined lean air/fuel ratio criterion.

According to another aspect of the invention, a method for controlling an air/fuel mixture ratio of an internal combustion engine, wherein the engine includes a catalyst located in an exhaust passage for adsorbing oxygen contained within exhaust gases entering the catalyst, an upstream air/fuel ratio sensor located in the exhaust passage upstream of the catalyst for detecting an air/fuel ratio based on a percentage of oxygen contained within the exhaust gases flowing through the exhaust passage and entering the catalyst, and a downstream air/fuel ratio sensor located in the exhaust passage downstream of the catalyst for detecting an air/fuel ratio based on a percentage of oxygen contained within the exhaust gases flowing through the exhaust passage and leaving the catalyst, the method comprises calculating a quantity of oxygen stored in the catalyst on the basis of a deviation of the air/fuel ratio detected by the upstream air/fuel ratio sensor from a stoichiometric air/fuel ratio, to produce informational data indicative of a calculated value of the quantity of oxygen stored, controlling an air/fuel mixture ratio so that the calculated value of the quantity of oxygen stored is adjusted to a desired value, determining whether the air/fuel ratio detected by the downstream air/fuel ratio sensor is a leaner air/fuel ratio than the stoichiometric air/fuel ratio, and terminating arithmetic-operation for the quantity of oxygen stored and updating the calculated value by a predetermined limit value of the quantity of oxygen stored in the catalyst, when the air/fuel ratio detected by the downstream air/fuel ratio sensor is the leaner air/fuel ratio and the calculated value of the quantity of oxygen stored is above the predetermined limit value.

DESCRIPTION OF THE PREFERRED EMBODIMENTS

Figure 1:
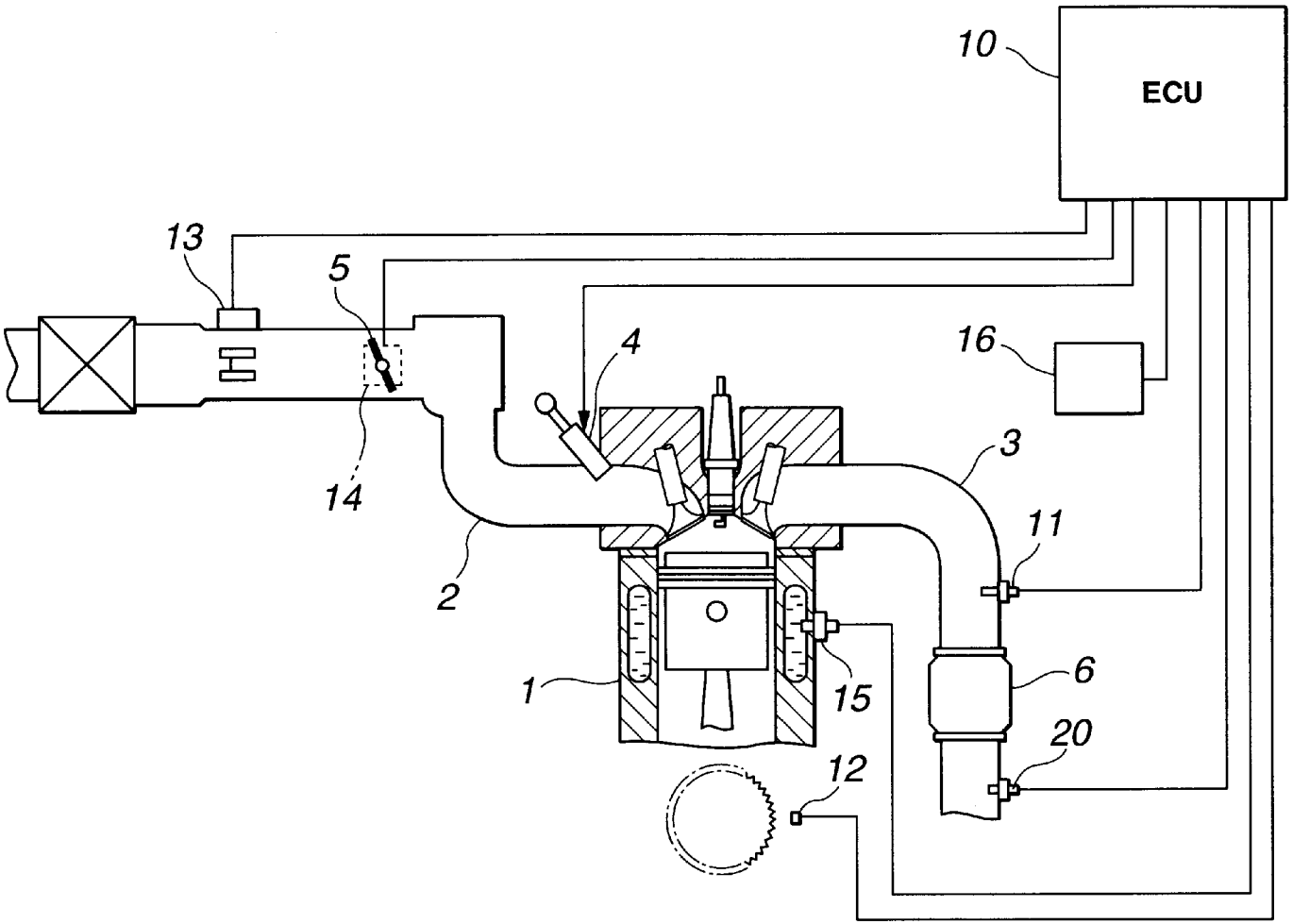
FIG. 1 is a system diagram illustrating the general system layout of a computer-controlled internal combustion engine equipped with an air/fuel mixture ratio (A/F ratio) control system and an emission control system.

Referring now to the drawings, particularly to FIG. 1, the A/F ratio control system of the invention is exemplified in case of an internal combustion engine equipped with a three-way catalytic converter (a three-way catalyst). In FIG. 1, an engine cylinder block is denoted by reference sign 1. Fresh air is introduced into each engine cylinder through an intake-air duct (or an intake-air passage) 2 and an intake manifold (not numbered). An intake-air quantity sensor 13, such as an air-flow meter, is located on the intake-air passage 2 for detecting a quantity of air flowing through the intake-air quantity sensor and drawn into the engine. A hot-wire mass air flow meter is commonly used as the intake-air quantity sensor which detects air flow (air quantity Qa) through the intake-air passage 2. A throttle valve 5 of a throttle body assembly (an electronically-controlled throttle unit) is provided in the intake-air passage 2. Reference sign 14 denotes a throttle opening sensor usually located on the throttle body and connected to the throttle linkage, for detecting a throttle opening TVO of the throttle valve 5. Fuel injectors 4 are provided at each of branched portions of the intake manifold. A spark plug (not numbered) is screwed into a tapped hole of the cylinder head for each combustion chamber to ignite the air fuel mixture in the combustion chamber. Hot burned gases from the engine cylinders are exhausted through an exhaust valve (not numbered) and an exhaust manifold (not numbered) into an exhaust passage 3. The three-way catalytic converter (the three-way catalyst 6) is located in the exhaust passage 3, to convert harmful exhaust gases (HC, CO, NOx) into harmless gases ($H_2O$, $CO_2$, $N_2$), and to reduce oxides of nitrogen (generally termed NOx), unburned hydrocarbons (HC), and carbon monoxide (CO). An upstream air/fuel ratio sensor (simply, an upstream A/F ratio sensor) 11 is located in the exhaust passage 3 upstream of the three-way catalyst 6, for monitoring or detecting an air/fuel mixture ratio (simply, an A/F ratio) AFSABF based on the percentage of oxygen contained within the engine exhaust gases flowing through the exhaust passage 3 and entering the catalyst 6, at all times when the engine is running, so that an electronic control module (ECM) or an electronic engine control unit (ECU) 10 can maintain the A/F ratio at as close to stoichiometric as possible, for complete combustion and minimum exhaust emissions. In the system of the embodiment, the upstream A/F ratio sensor 11 has a linear characteristic that an output voltage signal from the upstream A/F ratio sensor 11 varies linearly with an actual air/fuel mixture ratio. Thus, the output voltage signal from the upstream A/F ratio sensor 11 tends to change in proportion to the actual A/F ratio all over a measurement range. That is, a high voltage signal from the upstream A/F ratio sensor 11 means that the air/fuel mixture is rich, whereas a low voltage signal from the sensor 11 means that the air/fuel mixture is lean. Generally, when the A/F ratio is lean (excess air), air is adsorbed or trapped by the three-way catalyst 6 and stored in the catalyst 6. Conversely, when the A/F ratio is rich (too much fuel), air is desorbed or released from the three-way catalyst 6. By virtue of such catalytic actions, that is, adsorption and desorption of oxygen by and from the three-way catalyst 6, the exhaust gas leaving the catalyst 6 contains less HC, CO, and NOx than the exhaust gas entering, and as a result of the exhaust gases are cleared or purified. In the system of the embodiment, a downstream air/fuel ratio sensor (simply, a downstream A/F ratio sensor) 20 is further located in the exhaust passage 3 downstream of the three-way catalyst 6, for monitoring or detecting an A/F ratio AFSABF2 based on the percentage of oxygen contained within the engine exhaust gases flowing through the exhaust passage 3 and leaving the catalyst 6, at all times when the engine is running. In the system of the embodiment, the downstream A/F ratio sensor 20 has a non-linear characteristic that an output voltage signal from the downstream A/F ratio sensor 20 varies, in a non-linear fashion, with an actual air/fuel mixture ratio, such that the output voltage signal value of the sensor 20 rapidly increases from the vicinity of the stoichiometric ratio. Alternatively, the downstream A/F ratio sensor 20 may be constructed as a sensor having a linear characteristic in the same manner as the upstream A/F ratio sensor. As discussed above, note that, in the system of the embodiment, the upstream A/F ratio sensor 11 is provided to detect the A/F ratio AFSABF based on the percentage of oxygen contained within the engine exhaust gases entering the catalyst 6, while the downstream A/F ratio sensor 20 is provided to detect the A/F ratio AFSABF2 based on the percentage of oxygen contained within the engine exhaust gases leaving the catalyst 6. In FIG. 1, reference sign 12 denotes a crank angle sensor which is usually mounted on the engine for monitoring engine speed Ne as well as a relative position of the engine crankshaft. Reference sign 15 denotes an engine temperature sensor (a coolant temperature sensor) which is mounted on the engine and usually screwed into one of top coolant passages for monitoring engine temperature (operating temperature of the engine) Te. Generally, engine coolant temperature is used as the engine temperature Te. Reference sign 16 denotes a vehicle speed sensor which is usually located at either the transmission or transaxle (on front-wheel drive vehicles) for monitoring the output shaft speed to the road wheels. The output shaft speed is relayed a pulsing voltage signal to the input interface of the of the ECU 10 and converted into the vehicle speed data vsp. Input information from the previously-noted engine/vehicle sensors 11, 12, 13, 14, 15, 16, and 20 is transmitted into the input interface of the electronic control unit (ECU) 10. The ECU 10 usually comprises a microcomputer. Although it is not clearly shown in FIG. 1, the ECU 10 includes a central processing unit (CPU) that performs necessary arithmetic calculations, processes informational data, compares input signals from engine/vehicle sensors to predetermined or preprogrammed threshold values, and makes necessary decisions of acceptance, and memories (RAM, ROM), an input/output interface, and driver circuits for amplification of output signals from the output interface. The ECU 10 performs data processing actions shown in FIGS. 2 or 4 which will be fully described later. The output interface of the ECU 10 is configured to be electronically connected often through the driver circuits to various electrical loads, such as the electronically-controlled throttle valve 5, fuel injector solenoids of the fuel injectors 4, and the spark plugs, for generating control command signals to operate these electrical loads. Particularly, in the system of the embodiment, as detailed in reference to the flow charts shown in FIGS. 2 and 4, the processor of the ECU 10 arithmetically calculates or estimates the oxygen storage quantity OSQH (exactly, the quantity of oxygen stored in the three-way catalyst 6), on the basis of the signals (AFSABF, (AFSABF2), Ne, Qa, TVO, Te, vsp) from the previously-noted sensors, and an oxygen adsorption speed $ADS_{speed}$ of the three-way catalyst 6. In order to properly control the A/F ratio, the ECU 10 determines the fuel-injection amount of the injector 4 (the amount of fuel delivered to the cylinder), so that the oxygen storage quantity OSQH of the three-way catalyst 6 is adjusted to a desired value (for example, substantially one-half of a limit value $OSQH_{LIMIT}$ of the oxygen storage quantity). Also, under a specified condition (described later), the ECU 10 terminates the arithmetic operation for the oxygen storage quantity OSQH and then limits the calculated value (OSQH) of the oxygen storage quantity to a predetermined limit value $OSQH_{LIMIT}$ of the quantity of oxygen stored in the three-way catalyst 6.

Figure 2:
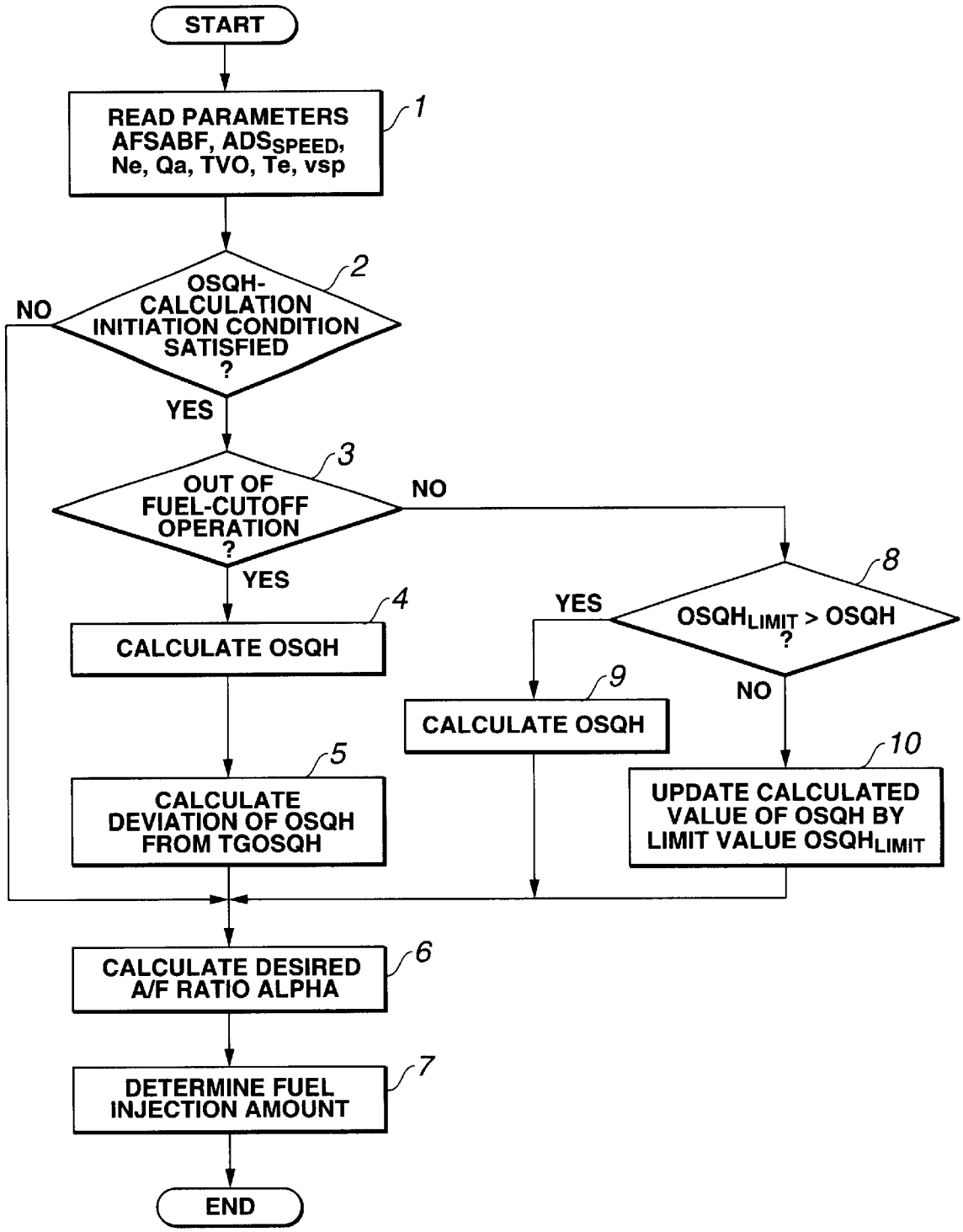
FIG. 2 is a flow chart illustrating one example of a sub-routine (a control procedure) executed by an electronic control unit (ECU) included in the A/F ratio control system of the embodiment.

Referring now to FIG. 2, there is shown the first control routine executed by the ECU 10 incorporated in the A/F ratio control system of the embodiment. The first control routine shown in FIG. 2 is executed as time-triggered interrupt routines to be triggered every predetermined time intervals such as 10 milliseconds.

At step 1, parameters needed to arithmetically calculate the oxygen storage quantity OSQH, namely the output AFSABF from the upstream A/F ratio sensor 11, the oxygen adsorption speed $ADS_{speed}$ of the three-way catalyst 6, and the intake-air quantity Qa (regarded as engine load), and conditional-decision parameters needed to determine whether specified conditions are satisfied, namely the engine speed Ne, the throttle opening TVO, the engine temperature Te, and the vehicle speed vsp, are read.

At step 2, a test is made to determine whether a specified arithmetic-calculation initiation condition needed to calculate or estimate the oxygen storage quantity OSQH of the three-way catalyst 6 is satisfied. In the system of the embodiment, the ECU 10 determines that the specified arithmetic-calculation initiation condition is met when the three-way catalyst 6 is in its activated state. In order for the computer to determine or estimate whether the catalyst 6 reaches a sufficient activation level, there are various ways, for example, direct temperature measurement of a temperature of the three-way catalyst 6, or estimation of the catalyst temperature from the engine temperature Te. In the shown embodiment, the ECU 10 determines the activated state of the catalyst 6, depending on whether the engine temperature Te is above a predetermined temperature value. When the answer to step 2 is in the negative (NO), the routine proceeds to step 6. Conversely, when the answer to step 2 is in the affirmative (YES), the routine proceeds to step 3.

At step 3, a test is made to determine whether the engine is out of a fuel-cutoff operating mode (a deceleration fuel-cutoff operating mode). The presence or absence of the fuel-cutoff operating mode is determined on the basis of the engine speed Ne, the throttle opening TVO, and the vehicle speed vsp. The deceleration fuel-cutoff operating mode is usually executed for example during down-hill driving or during engine speed limitation when the maximum allowable engine speed is reached. When the answer to step 3 is negative (NO), that is, during the fuel cutoff operating mode, step 8 occurs. Conversely, when the answer to step 3 is affirmative (YES), the routine proceeds to step 4.

At step 4, the oxygen storage quantity OSQH is arithmetically calculated or estimated on the basis of the deviation (divergency) of the A/F ratio AFSABF detected by the upstream A/F ratio sensor 11 from the stoichiometric A/F ratio AFSM, by way of the following expression (1).

$$OSQH=\{(AFSABF-AFSM)/AFSM\}\times Qa\times ADS_{speed}+HSOSQ \quad (1)$$

where AFSABF denotes a current value $AFSABF_{(n)}$ of the A/F ratio detected by the upstream A/F sensor 11, AFSM denotes the stoichiometric A/F ratio, Qa denotes the intake-air quantity, $ADS_{speed}$ denotes the oxygen adsorption speed of the three-way catalyst 6, and HSOSQ means AFSABF $_{(n-1)}$ and denotes a previous value of the oxygen storage quantity calculated one cycle before. The previously-noted oxygen adsorption speed $ADS_{speed}$ is a variable. That is, the leaner the A/F ratio AFSABF detected by the upstream A/F ratio sensor 11, the higher the oxygen adsorption speed $ADS_{speed}$. In other words, the richer the A/F ratio AFSABF detected by the upstream A/F ratio sensor 11, the lower the oxygen adsorption speed $ADS_{speed}$. As can be appreciated from the expression (1), when the A/F ratio AFSABF detected by the upstream A/F ratio sensor is a leaner ratio (AFSABF−AFSM>0) in comparison with the stoichiometric ratio AFSM, the calculated oxygen storage quantity OSQH tends to increase. To the contrary, when the A/F ratio AFSABF detected by the upstream A/F ratio sensor is a richer ratio (AFSABF−AFSM<0) in comparison with the stoichiometric ratio AFSM, the calculated oxygen storage quantity OSQH tends to decrease. Then, the calculated value of oxygen storage quantity, obtained through step 4, is stored in a predetermined memory address as a current value $OSQH_{(n)}$.

At step 5, a deviation (TGOSQH−OSQH) of the calculated oxygen storage quantity OSQH from a desired value or a predetermined target oxygen storage quantity TGOSQH is calculated. The predetermined target oxygen storage quantity TGOSQH is set at a substantially one-half of the limit value OSQHLIMIT of oxygen storage quantity.

At step 6, a desired A/F ratio ALPHA is arithmetically calculated on the basis of the deviation (TGOSQH—OSQH) obtained through step 5, from the following expression (2) for PID control (proportional-plus-integral-plus-derivative control). As may be appreciated from the above, in the system of the embodiment, proportional-plus-integral-plus-derivative (PID) control in which the control signal from the ECU is a linear combination of the error signal, its integral and its derivative, is used as the feedback control for the A/F ratio.

$$ALPHA=[AFSM/\{1-(TGOSQH-OSQH)\times PID/Qa\}-AFSABF]/AFSABF\times PID \quad (2)$$

where PID denotes a proportional-plus-integral-plus-derivative gain. As can be appreciated from the expression (2), when the calculated oxygen storage quantity OSQH of the three-way catalyst 6 is greater than the predetermined target oxygen storage quantity TGOSQH, that is, in case of TGOSQH−OSQH<0, the desired A/F ratio ALPHA is controlled toward a richer ratio. To the contrary, when the calculated oxygen storage quantity OSQH of the three-way catalyst 6 is less than the predetermined target oxygen storage quantity TGOSQH, that is, in case of TGOSQH−OSQH>0, the desired A/F ratio ALPHA is controlled toward a leaner ratio.

At step 7, a fuel-injection amount is determined on the basis of engine speed Ne, engine load (e.g., the intake-air quantity Qa), and the desired A/F ratio ALPHA. First, a basic fuel-injection amount is calculated as K×Qa/Ne, where K denotes a predetermined constant. Second, the fuel-injection amount is calculated as the product (ALPHA×K×Qa/Ne) of the basic fuel-injection amount and the desired A/F ratio ALPHA.

On the other hand, during the deceleration fuel cutoff mode, at step 8, a limit check is made to determine whether the calculated oxygen storage quantity (exactly, a previous value $OSQH_{(n-1)}$ of the calculated oxygen storage quantity, calculated one cycle before) is less than the predetermined limit value OSQHLIMIT (the maximum allowable oxygen storage quantity). When the answer to step 8 is affirmative (YES), that is, in case of OSQHLIMIT>OSQH(n−1), the routine proceeds to step 9. At step 9, the oxygen storage quantity OSQH is arithmetically calculated or estimated in the same manner as step 4, and then the calculated value of oxygen storage quantity is stored in the memory address as the current value $OSQH_{(n)}$. Conversely, when the answer to step 8 is negative (NO), that is, in case of OSQHLIMIT≦$OSQH_{(n-1)}$, the routine proceeds to step 10. At step 10, the ECU 10 operates to terminate arithmetic calculation for the oxygen storage quantity OSQH of the three-way catalyst 6, for the purpose of estimate limitation of the oxygen storage quantity. Then, the calculated value of oxygen storage quantity is limited to or updated by the predetermined limit value OSQHLIMIT. In other words, the flow from step 3 via step 8 to step 10 functions as a limiter (or a limiter circuit) which prevents the calculated oxygen storage quantity OSQH from exceeding a specified level, that is, the predetermined limit value OSQHLIMIT. After step 10, the routine flows to step 6. During the fuel cutoff mode, the desired A/F ratio ALPHA is set at "0" at step 6, and the fuel-injection amount is also set at "0" at step 7.

Figures 3A, 3B, 3C:
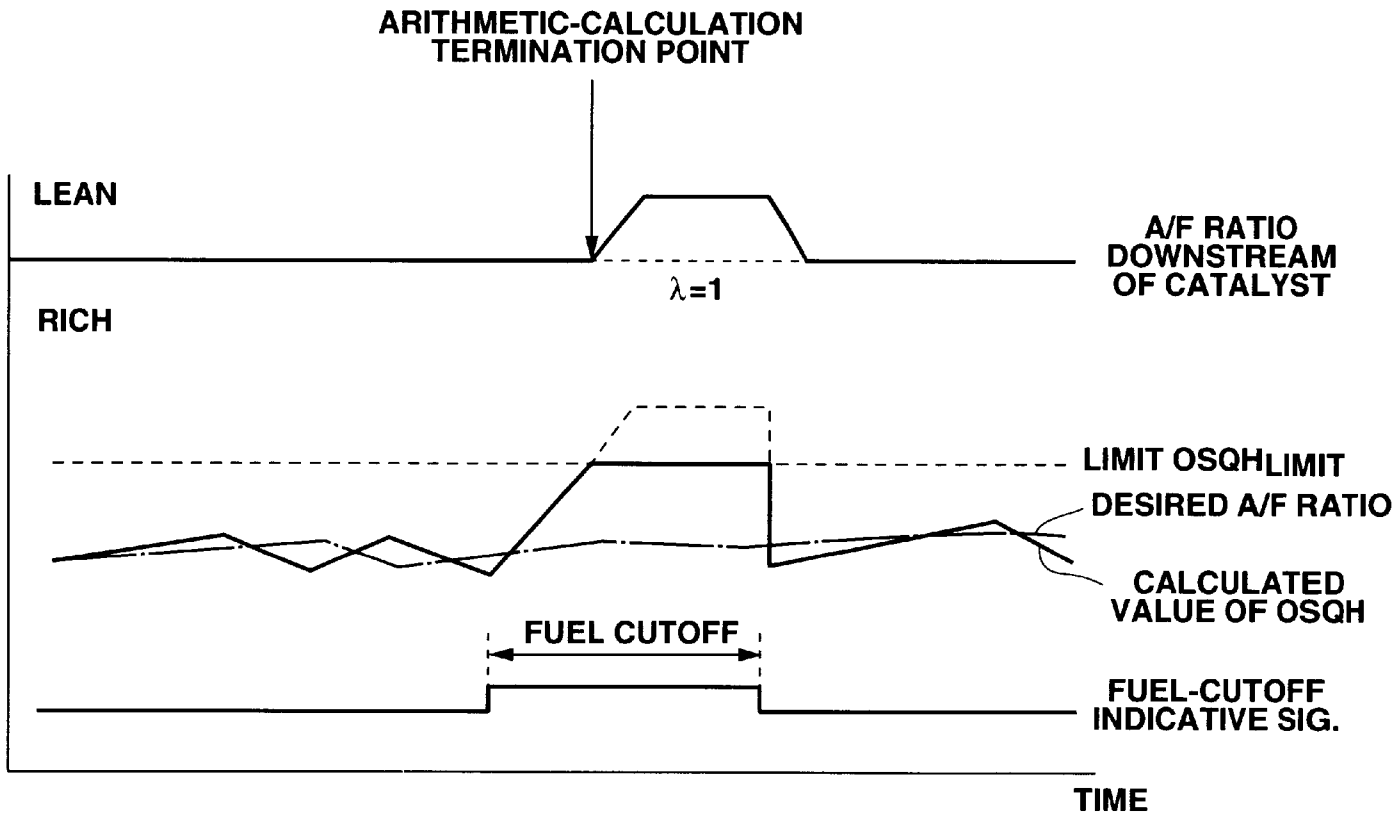
FIGS. 3A through 3C are timing charts illustrating the operation of the A/F ratio control system (related to the flow chart shown in FIGS. 2 and 4).

With the previously-discussed arrangement, during the deceleration fuel cutoff where the oxygen storage quantity of the three-way catalyst will rapidly rise and the limit value (the maximum allowable oxygen storage quantity) will be reached soon, as indicated by the vertical arrow in FIGS. 3A–3C, the ECU 10 terminates the arithmetic operation for the oxygen storage quantity immediately when the calculated value $OSQH_{(n-1)}$ of oxygen storage quantity reaches the predetermined limit value OSQHLIMIT. As a result of this, during the deceleration fuel cutoff, the ECU 10 preserves the current value $OSQH_{(n)}$ of oxygen storage quantity at the limit value OSQHLIMIT. FIG. 3A shows variations in the A/F ratio AFSABF2 based on the percentage of oxygen contained within the engine exhaust gases leaving the catalyst 6 and detected by the downstream A/F ratio sensor 20. In FIG. 3A, a horizontal line indicated by lambda=1 shows the stoichiometric ratio. In FIG. 3B, the upper horizontal straight broken line indicates the predetermined limit value OSQHLIMIT of oxygen storage quantity, the solid polygonal line indicates variations in the calculated value $OSQH_{(n)}$ of oxygen storage quantity OSQH, and the one-dotted line indicates variations in the desired A/F ratio ALPHA. In FIG. 3B, the (trapezoidal) hypothetical line above the upper horizontal straight broken line indicating the predetermined oxygen-storage-quantity limit value OSQHLIMIT shows variations in the calculated value of the oxygen storage quantity OSQH, produced by the conventional system, during the deceleration fuel shutoff. In FIG. 3C, the central pulsed area indicates the deceleration fuel cutoff operating-mode zone. As discussed above, even during the deceleration fuel cutoff, there is no difference between the calculated oxygen storage quantity $OSQH_{(n)}$ and the limit value OSQHLIMIT of oxygen storage quantity of the three-way catalyst 6. This ensures very precise control of A/F ratio, even when the engine/vehicle operating condition is recovered from a specific engine/vehicle operating condition containing during deceleration fuel cutoff to a normal operating mode.

Figure 4:
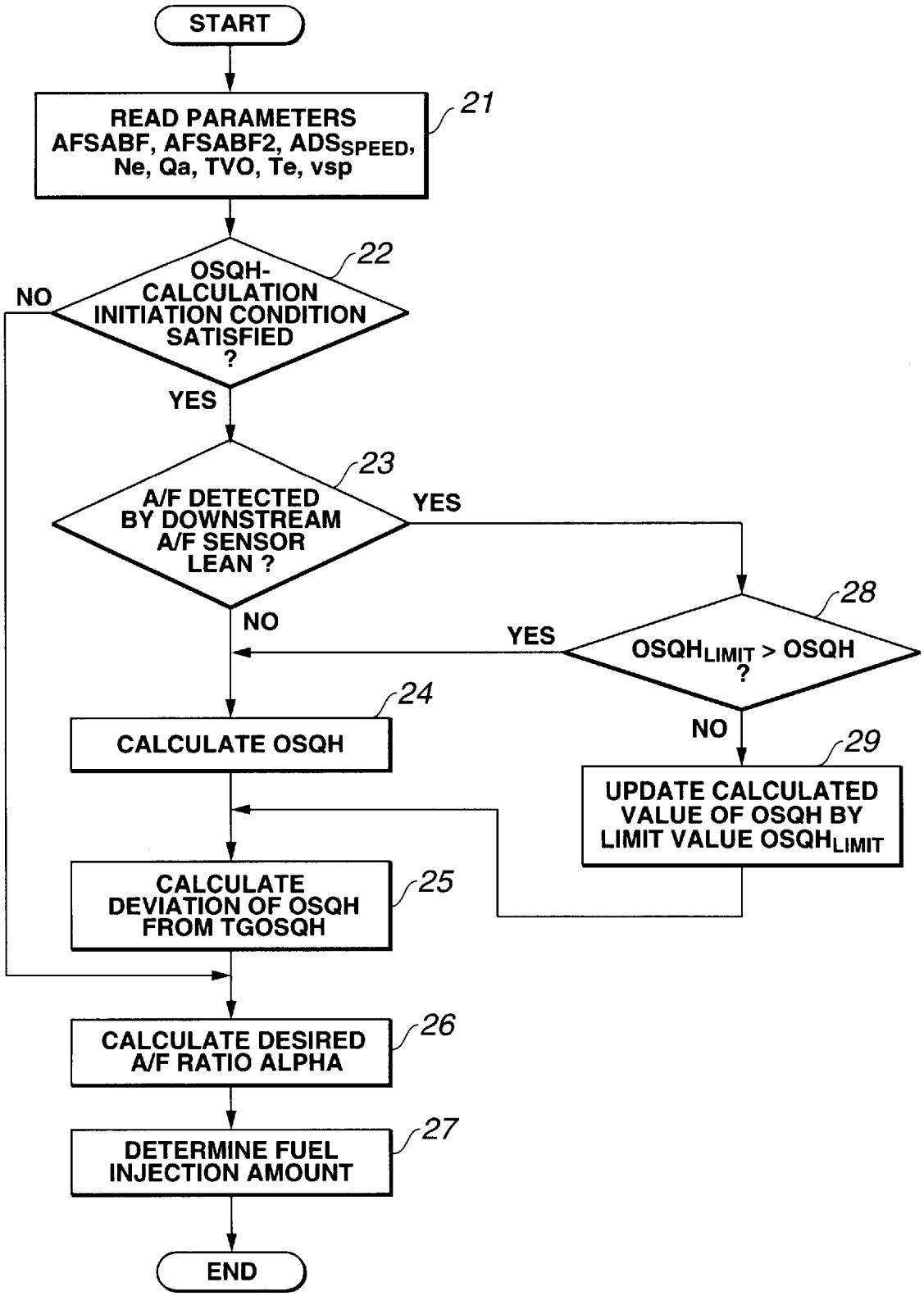
FIG. 4 is a flow chart illustrating another example of a sub-routine (a control procedure) executed by the electronic control unit (ECU) included in the A/F ratio control system of the embodiment.

Referring now to FIG. 4, there is shown the second control routine executed by the ECU 10 incorporated in the A/F ratio control system of the embodiment. The second control routine shown in FIG. 4 is executed as time-triggered interrupt routines to be triggered every predetermined time intervals such as 10 milliseconds. The second routine is aimed at executing proper and precise A/F control not only during fuel cutoff, but also when the calculated oxygen storage quantity (exactly, the previous value $OSQH_{(n-1)}$ of the calculated oxygen storage quantity) is above the predetermined limit value OSQHLIMIT of the three-way catalyst 6.

At step 21, parameters needed to arithmetically calculate the oxygen storage quantity OSQH, namely the output AFSABF from the upstream A/F ratio sensor 11, the oxygen adsorption speed $ADS_{speed}$ of the three-way catalyst 6, and the intake-air quantity Qa (regarded as engine load), and conditional-decision parameters needed to determine whether specified conditions are satisfied, namely the engine speed Ne, the throttle opening TVO, the engine temperature Te, the vehicle speed vsp and the output AFSABF2 from the downstream A/F ratio sensor 20 are read.

At step 22, a test is made to determine whether a specified arithmetic-calculation initiation condition needed to calculate or estimate the oxygen storage quantity OSQH of the three-way catalyst 6 is satisfied. The ECU 10 determines that the specified arithmetic-calculation initiation condition is met when the three-way catalyst 6 is in its activated state. Actually, the ECU 10 determines the activated state of the catalyst 6, depending on whether the engine temperature Te is above a predetermined temperature value. When the answer to step 22 is in the negative (NO), the routine proceeds to step 26. Conversely, when the answer to step 22 is in the affirmative (YES), the routine proceeds to step 23.

At step 23, a check is made to determine whether the A/F ratio AFSABF2, which is detected by the downstream A/F ratio sensor 20 and based on the percentage of oxygen contained within the engine exhaust gases leaving the three-way catalyst 6, is a lean A/F ratio. When the answer to step 23 is affirmative (YES), that is, when the A/F ratio AFSABF2 detected by the downstream A/F ratio sensor 20 is a lean A/F ratio, the routine proceeds to step 28. Conversely, when the answer to step 23 is negative (NO), that is, when the A/F ratio AFSABF2 is a stoichiometric A/F ratio or a rich A/F ratio, the routine proceeds to step 24.

At step 24, in the same manner as step 4, the oxygen storage quantity OSQH is arithmetically calculated or estimated on the basis of the deviation of the A/F ratio AFSABF detected by the upstream A/F ratio sensor 11 and based on the percentage of oxygen contained within the engine exhaust gases entering the three-way catalyst 6 from the stoichiometric air/fuel ratio AFSM, by way of the previously-discussed expression $OSQH=\{(AFSABF-AFSM)/AFSM\}\times Qa\times ADS_{speed}+HSOSQ$.

Thereafter, at step 25, in the same manner as step 5, a deviation (TGOSQH−OSQH) of the calculated oxygen storage quantity OSQH from a predetermined target oxygen storage quantity TGOSQH is calculated.

At step 26, in the same manner as step 6, a desired A/F ratio ALPHA is arithmetically calculated on the basis of the deviation (TGOSQH−OSQH) obtained through step 25, from the previously-discussed expression $ALPHA=[AFSM/\{1-(TGOSQH-OSQH)\times PID/Qa\}-AFSABF]/AFSABF\times PID$, where PID denotes a proportional-plus-integral-plus-derivative gain.

At step 27, in the same manner as step 7, a fuel-injection amount is determined on the basis of engine speed Ne, engine load (e.g., the intake-air quantity Qa), and the desired A/F ratio ALPHA. First, a basic fuel-injection amount is calculated as $K\times Qa/Ne$, where K denotes a predetermined constant. Second, the fuel-injection amount is calculated as the product ($ALPHA\times K\times Qa/Ne$) of the basic fuel-injection amount and the desired A/F ratio ALPHA.

In contrast to the above, when the A/F ratio AFSABF2, which is detected by the downstream A/F ratio sensor 20 and based on the percentage of oxygen contained within the engine exhaust gases leaving the three-way catalyst 6, is a lean A/F ratio, the routine proceeds from step 23 to step 28. At step 28, a limit check is made to determine whether the calculated oxygen storage quantity (exactly, a previous value $OSQH_{(n-1)}$ of the calculated oxygen storage quantity, calculated one cycle before) is less than the predetermined limit value OSQHLIMIT (the maximum allowable oxygen storage quantity). When the answer to step 28 is affirmative (YES), that is, in case of $OSQH_{LIMIT}>OSQH_{(n-1)}$, the routine flows to step 24 at which the oxygen storage quantity OSQH is calculated or estimated by way of the previously-discussed expression (1), and then the calculated value of oxygen storage quantity is stored in the memory address as the current value $OSQH_{(n)}$. Conversely, when the answer to step 28 is negative (NO), that is, in case of $OSQH_{LIMIT}\leqq OSQH_{(n-1)}$, the routine proceeds to step 29. At step 29, the ECU 10 operates to terminate arithmetic calculation for the oxygen storage quantity OSQH of the three-way catalyst 6, for the purpose of estimate limitation of the oxygen storage quantity. Then, the calculated value of oxygen storage quantity is limited to or updated by the predetermined limit value OSQHLIMIT. In other words, the flow from step 23 via step 28 to step 29 functions as a limiter circuit which prevents the calculated oxygen storage quantity OSQH from exceeding a specified level, that is, the predetermined limit value OSQHLIMIT. After step 29, the routine flows to step 25.

As set forth above, according to the second routine shown in FIG. 4, as seen in FIGS. 3A–3C, when the A/F ratio AFSABF2 based on the percentage of oxygen contained within the engine exhaust gases leaving the three-way catalyst 6 becomes a lean A/F ratio, and then the calculated value (the previous value $OSQH_{(n-1)}$) of the oxygen storage quantity reaches the limit value OSQHLIMIT, the ECU 10 terminates the arithmetic operation for the oxygen storage quantity at once. As a consequence, when the necessary conditions, namely a lean A/F ratio AFSABF2 and $OSQH_{LIMIT}\leqq OSQH$, are met, the ECU 10 preserves the current value $OSQH_{(n)}$ of oxygen storage quantity at the limit value OSQHLIMIT. Thus, when the previously-noted necessary conditions are met, there is no difference between the calculated oxygen storage quantity $OSQH_{(n)}$ and the limit value OSQHLIMIT of oxygen storage quantity of the three-way catalyst 6. This ensures very precise control of A/F ratio, based on the estimated or calculated value of oxygen storage quantity of the catalyst, even when the engine/vehicle operating condition is recovered from the lean operating condition to a correct (stoichiometric) operating condition, after a lean operating condition continues for a while due to some factor.

Figure 5:
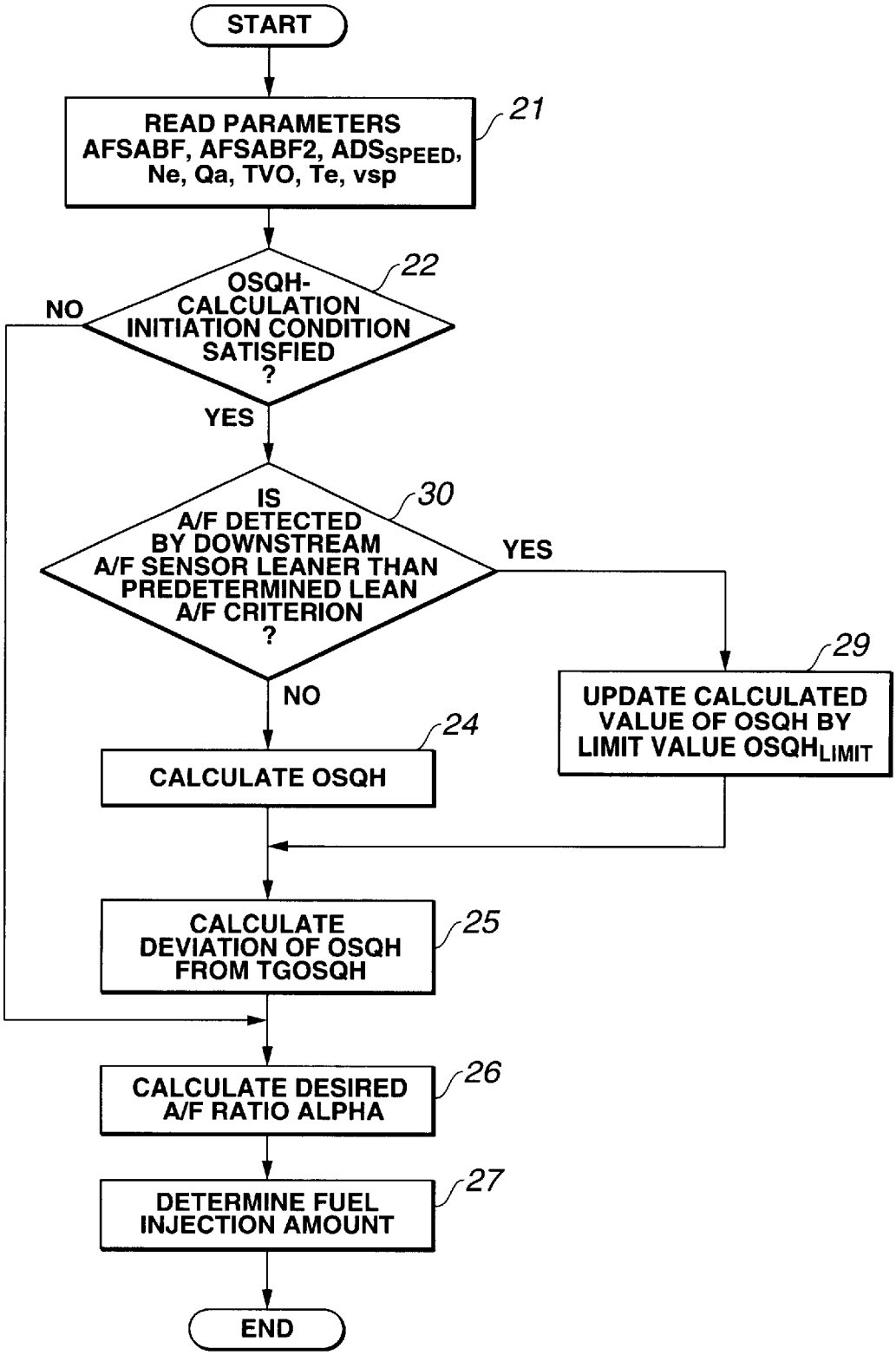
FIG. 5 is a flow chart illustrating a further example of a sub-routine (a control procedure) executed by the electronic control unit (ECU) included in the A/F ratio control system of the embodiment.

Referring now to FIG. 5, there is shown the third control routine executed by the ECU 10 incorporated in the A/F ratio control system of the embodiment. The third control routine shown in FIG. 5 is similar to the second control routine shown in FIG. 4, except that steps 23 and 28 included in the routine shown in FIG. 4 are replaced with step 30 included in the routine shown in FIG. 5. Thus, the same step numbers used to designate steps in the routine shown in FIG. 4 will be applied to the corresponding step numbers used in the modified arithmetic processing shown in FIG. 5, for the purpose of comparison of the two different interrupt routines. Step 30 will be hereinafter described in detail with reference to the accompanying drawings, while detailed description of steps 21, 22, and 24–29 will be omitted because the above description thereon seems to be self-explanatory. The third routine is aimed at executing proper and precise A/F control not only during fuel cutoff, but also when the A/F ratio AFSABF2 is leaner than a predetermined lean A/F criterion.

At step 30, a check is made to determine whether the A/F ratio AFSABF2, which is detected by the downstream A/F ratio sensor 20 and based on the percentage of oxygen contained within the engine exhaust gases leaving the three-way catalyst 6, is leaner than a predetermined lean A/F criterion. When the answer to step 30 is in the negative (NO), the routine proceeds to step 24, and then flows through steps 25 and 26 to step 27. Conversely, when the answer to step 30 is in the affirmative (YES), the routine proceeds to step 29 where the ECU 10 operates to terminate arithmetic calculation for the oxygen storage quantity OSQH, and then the calculated value of oxygen storage quantity is limited to or updated by a predetermined limit value OSQHLIMIT. That is to say, the flow from step 30 to step 29 serves as a limiter circuit which prevents the calculated oxygen storage quantity OSQH from exceeding a specified level. Thereafter, the routine proceeds from step 29 to step 25. The third routine shown in FIG. 5 provides the same effects as the second routine shown in FIG. 4.

The entire contents of Japanese Patent Application Nos. Pll-55693 (filed Mar. 3, 1999) and P2000-44723 (filed Feb. 22, 2000) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An air/fuel ratio control system of an internal combustion engine, comprising:

a catalyst located in an exhaust passage, for adsorbing oxygen contained within exhaust gases entering the catalyst;

an air/fuel ratio sensor located in the exhaust passage upstream of the catalyst, for detecting an air/fuel ratio based on a percentage of oxygen contained within the exhaust gases flowing through the exhaust passage and entering the catalyst; and a control unit configured to be electronically connected to the air/fuel ratio sensor, for controlling an air/fuel mixture ratio at as close to stoichiometric as possible, said control unit comprising (a) an arithmetic-calculation section which calculates a quantity of oxygen stored in the catalyst on the basis of a deviation of the air/fuel ratio detected by the air/fuel ratio sensor from a stoichiometric air/fuel ratio, to produce informational data indicative of a calculated value of the quantity of oxygen stored, (b) a control section which controls an air/fuel mixture ratio so that the calculated value of the quantity of oxygen stored is adjusted to a desired value, and (c) a limiter which prevents the calculated value of the quantity of oxygen stored from exceeding a predetermined limit value of the quantity of oxygen stored in the catalyst, said limiter comprising (1) a determination section which determines whether the engine operates at a fuel cutoff operating mode, and (2) an update section which, when the calculated value of the quantity of oxygen stored is above the predetermined limit value during the fuel cutoff operating mode, terminates arithmetic-operation for the quantity of oxygen stored, executed by the arithmetic-calculation section, and updates the calculated value by the predetermined limit value.

2. The air/fuel ratio control system as claimed in claim 1, wherein the predetermined limit value of the catalyst is set at a maximum allowable quantity of oxygen stored in the catalyst, and the desired value is set at substantially one-half of the maximum allowable quantity of oxygen stored.

3. In an internal combustion engine having a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, an air/fuel ratio control system for controlling an air/fuel mixture ratio of the internal combustion engine at as close to stoichiometric as possible, comprising:

(a) an arithmetic-calculation means for calculating a quantity of oxygen stored in the catalyst on the basis of a deviation of the air/fuel ratio detected by the air/fuel ratio sensor from a stoichiometric air/fuel ratio, to produce informational data indicative of a calculated value of the quantity of oxygen stored, (b) a control means for controlling an air/fuel mixture ratio so that the calculated value of the quantity of oxygen stored is adjusted to a desired value, and (c) a limiter means for preventing the calculated value of the quantity of oxygen stored from exceeding a predetermined limit value of the quantity of oxygen stored in the catalyst, said limiter means comprising (1) a determination means for determining whether the engine operates at a fuel cutoff operating mode, and (2) an update means for terminating arithmetic-operation for the quantity of oxygen stored, executed by the arithmetic-calculation means and for updating the calculated value by the predetermined limit value, when the calculated value of the quantity of oxygen stored is above the predetermined limit value during the fuel cutoff operating mode.

4. A method for controlling an air/fuel mixture ratio of an internal combustion engine, wherein the engine includes a catalyst located in an exhaust passage for adsorbing oxygen contained within exhaust gases entering the catalyst, and an air/fuel ratio sensor located in the exhaust passage upstream of the catalyst for detecting an air/fuel ratio based on a percentage of oxygen contained within the exhaust gases flowing through the exhaust passage and entering the catalyst, the method comprising:

calculating a quantity of oxygen stored in the catalyst on the basis of a deviation of the air/fuel ratio detected by the air/fuel ratio sensor from a stoichiometric air/fuel ratio, to produce informational data indicative of a calculated value of the quantity of oxygen stored, controlling an air/fuel mixture ratio so that the calculated value of the quantity of oxygen stored is adjusted to a desired value, determining whether the engine operates at a fuel cutoff operating mode, terminating arithmetic-operation for the quantity of oxygen stored and updating the calculated value by a predetermined limit value of the quantity of oxygen stored in the catalyst, when the calculated value of the quantity of oxygen stored is above the predetermined limit value during the fuel cutoff operating mode.

* * * * *